US005653505A

United States Patent [19]

Holobaugh, Jr.

[11] Patent Number: 5,653,505

[45] **Date of Patent: *Aug. 5, 1997**

[54] CHAIR AND MECHANISM WITH RESTRAINED FREE ROCKING AND GLIDING MOVEMENT

[75] Inventor: Raymond E. Holobaugh, Jr., Jamestown, N.C.

[73] Assignee: Parma Corporation, Denton, N.C.

[ * ] Notice: The term of this patent shall not extend beyond the expiration date of Pat. No. 5,427,433.

[21] Appl. No.: 463,314

[22] Filed: Jun. 2, 1995

Related U.S. Application Data

[63] Continuation-in-part of Ser. No. 153,685, Nov. 17, 1993, Pat. No. 5,427,433.

[51] Int. Cl.[6] ..... A47C 3/02

[52] U.S. Cl. ..... 297/273; 248/586; 297/266.1; 297/281; 297/344.11

[58] Field of Search ..... 297/266.1, 273, 297/281, 282, 258.1, 344.11, 423.43, 423.44, DIG. 7; 248/202.1, 370, 581, 586, 595

[56] References Cited

U.S. PATENT DOCUMENTS

| | | | |
|---|---|---|---|
| 326,361 | 9/1885 | Watkins | 297/266.1 |
| 2,822,861 | 2/1958 | Parent | 297/423.42 X |
| 3,170,666 | 2/1965 | Reiter et al. | 297/344.11 X |
| 3,220,772 | 11/1965 | Lucky | 297/423.42 |
| 3,926,472 | 12/1975 | Evans | 297/DIG. 7 X |
| 4,536,029 | 8/1985 | Rogers, Jr. | 297/281 |

*Primary Examiner*—Peter R. Brown
*Attorney, Agent, or Firm*—Kirschstein, et al.

[57] ABSTRACT

A highly compact, stable mechanism for enabling a chair to perform rocking and gliding movements, and optionally swiveling movement, includes a channel-shaped frame mounting member mounted to a chair frame, and an inverted channel-shaped base mounting member mounted on a base. The mounting members are interconnected by one pair of front and one pair of rear swing arms, and also by a pair of tensioned springs operative for restraining the rocking and gliding movements.

10 Claims, 7 Drawing Sheets

CHAIR AND MECHANISM WITH RESTRAINED FREE ROCKING AND GLIDING MOVEMENT

CROSS REFERENCE TO RELATED APPLICATION

This application is a continuation-in-part of U.S. application Ser. No. 08/153,685, filed Nov. 17, 1993, now U.S. Pat. No. 5,427,433.

BACKGROUND OF THE INVENTION

1. Field of the Invention

This invention generally relates to a chair having a rocking and gliding motion and, more particularly, to a highly compact mechanism that provides a highly stable and restrained free rocking and gliding action without sacrificing stability or low seat styling.

2. Description of the Related Art

Rockers and gliders are well known. For example, U.S. Pat. Nos. 4,536,029 and 4,544,201 each discloses a combined rocking, gliding chair in which a chair structure including a seat, armrests, and a backrest is suspended from multiple swing arms of a linkage mechanism that, in turn, is mounted on a stationary base. Although generally satisfactory for their intended purpose, the suspension-type chairs of the above-identified patents have not proven to be altogether desirable.

For example, the known linkage mechanism requires a clear mounting height of 18 through 25 centimeters under the seat. This is simply too high for many, modern, low seat styled, chairs, and especially for chairs having internal seat springs.

Also, the chair structure is mounted on the very bottom of the known linkage mechanism, as close to the floor as possible, in an effort to increase chair stability. However, this causes the lengths of the swing arms to be very long and, in turn, causes the tilt angles that the chair structure assumes, especially in its end-limiting positions, to be somewhat excessive for the comfort of a seated occupant.

In addition, the chair structure is mounted exteriorly outboard of the known linkage mechanism, as far apart as possible, in another effort to increase chair stability. However, this causes the known linkage mechanism to be somewhat wider than it otherwise had to be and, in turn, contributed to an increase in the weight and size of the overall chair.

Still another undesirable aspect related to the use of cross-stabilizer bars between front and rear pairs of swing arms on the known linkage mechanism. Such bars added complexity and cost.

SUMMARY OF THE INVENTION

OBJECTS OF THE INVENTION

It is a general object of this invention to provide an improved rocking, gliding chair designed to meet low seat styling requirements.

Another object of this invention is to provide such a chair having a stable, comfortable, rocking and gliding motion.

An additional object of this invention is to provide a highly compact, rocking, gliding mechanism that accommodates seat springs.

Another object of this invention is to provide such a highly compact mechanism that does not require cross-stabilizer bars.

An additional object of this invention to provide such a mechanism that is easily modified to perform a swivel action during use.

Yet another object of this invention is to provide an inexpensive, stable, functional rocker and glider.

Another object of this invention is to restrain free rocking and gliding movement in such a chair and mechanism.

FEATURES OF THE INVENTION

In keeping with these objects and others which will become apparent hereinafter, one feature of this invention resides, briefly stated, in a rocking, gliding chair, which comprises a base, a body-supporting chair frame, and means for mounting the chair frame on the base for rocking and gliding movement relative to the base.

The mounting means includes a channel-shaped base mounting member having a generally planar base plate mounted on the base, and a pair of generally planar base side walls extending upwardly from the base plate. A channel-shaped frame mounting member is inverted relative to the base mounting member and has a generally planar top plate overlying the base plate and mounted to the frame, and a pair of generally planar frame side walls extending downwardly from the top plate and overlapping the base side walls. One pair of front and one pair of rear swing arms are provided. Each pair is located between a respective base side wall and a respective overlapping frame side wall. Each arm has opposite ends respectively pivotably connected to a respective base side wall and a respective overlapping frame side wall.

In accordance with this invention, means are connected between the base mounting member and the frame mounting member, for restraining free rocking and gliding movement of the chair frame relative to the base. In the preferred embodiment, the restraining means includes at least one tensioned spring, and preferably a pair of tensioned springs, each spring having opposite ends respectively connected to the base mounting member and the frame mounting member. The springs are advantageously centrally located within the mounting members and criss-cross each other.

In the preferred embodiment, the base side walls are mutually parallel and extend toward, but terminate short of, the top plate. The frame side walls are mutually parallel and extend toward and past the base plate. Preferably each base side wall and frame side wall has a trapezoidal shape, and each plate has a rectangular shape.

Each front arm has an upper end region pivotably connected to a respective base side wall at an upper front pivot, and a lower end region pivotably connected to a respective overlapping frame side wall at a lower front pivot. Each rear arm has an upper end region pivotably connected to a respective base side wall at an upper rear pivot, and a lower end region pivotably connected to a respective overlapping frame side wall at a lower rear pivot. Each upper from pivot is spaced along a longitudinal direction away from a respective upper rear pivot by a predetermined upper spacing, preferably less than 18 centimeters. Each lower front pivot is spaced along the longitudinal direction away from a respective lower rear pivot by a predetermined lower spacing, preferably less than 14.5 centimeters. The predetermined upper spacing is always greater than said predetermined lower spacing in order to achieve the aforementioned rocking, gliding action.

Each swing arm preferably has a length which is less than 10.25 centimeters. Each arm has an offset portion located between the upper and lower end regions thereof, and spans the overlap between a respective base side wall and a respective overlapping frame side wall.

The mounting means or mechanism of this invention requires a clear mounting height between the base and top plates of less than 10.25 centimeters, much reduced compared to the 18 centimeter through 25 centimeter mounting height required in prior art constructions. This vertically compact design is ideal for modem, low seat styled chairs, and easily accommodates internal seat springs.

The body-supporting chair frame is no longer mounted on the very bottom of the mechanism as close to the floor as possible, or exteriorly outboard of the mechanism as far apart as possible, but, instead, is mounted directly on top of the top plate of the mechanism. Good chair stability is achieved, because the mechanism is so vertically compact, and the lengths of the swing arms are not overly long.

Cross-stabilizing bars are no longer needed between the front swing arms, or between the rear swing arms. When the channel-shaped frame mounting member moves back and forth, the swing arms mounted thereon move in synchronism. Moreover, the overlapping frame and base side walls effectively protect the swing arms from lateral encroachment.

Still another feature of this invention resides in providing stop means on the mechanism, for limiting the extent of the rocking and gliding movement relative to the base. Preferably, the stop means includes one pair of front and one pair of rear abutments, e.g., cushioned stop pins, each pair being spaced apart along a longitudinal direction and mounted on a respective base side wall in the path of swinging movement of the arms.

In accordance with another feature of this invention, swivel means may be provided between the base and the mechanism, for swiveling the chair frame about a vertical axis. The swivel means includes a first race formed in the base plate, a second race formed in the base, and ball bearings in the races.

The frame itself conventionally includes a seat, a backrest and a pair of armrests fixed to opposite sides of the seat. The mechanism is located underneath the seat, forwardly of the backrest, and between the armrests. The seat, backrest and armrests may be a unitary upholstered structure, or in the case of a recliner, the backrest is movable relative to the seat. In order to prevent the rocking, gliding motion when the recliner is in a reclined position, a blocking linkage means is incorporated with the mechanism.

The tensioned springs add resistance during the rocking, gliding movement. One spring stretches, while the other relaxes, during forward motion, and vice versa during rearward motion. Each stretched spring effectively restrains flee rocking, gliding movement and imparts a greater level of user comfort during use of the chair.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
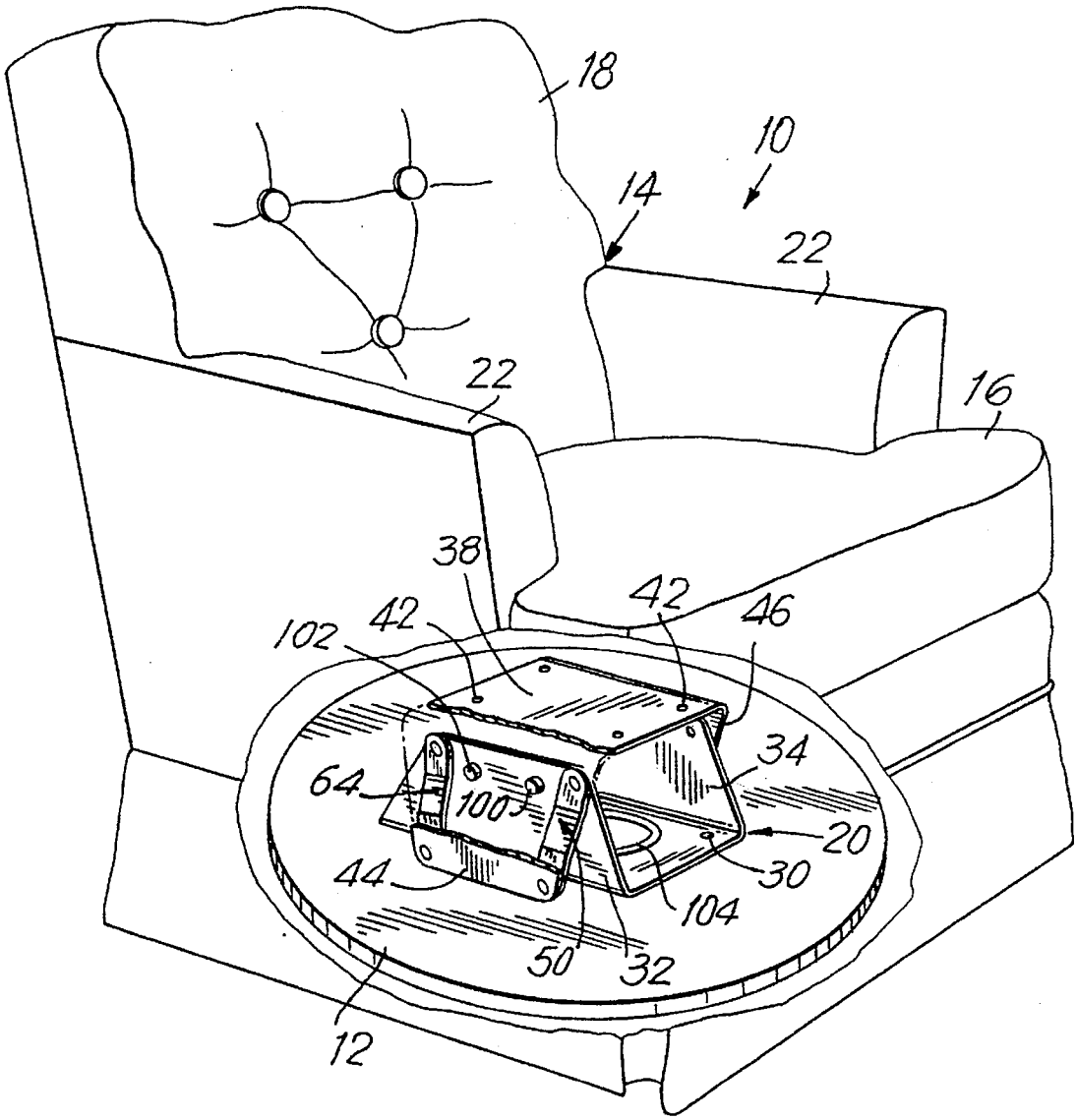
FIG. 1 is a broken-away perspective view of a rocking, gliding chair equipped with a mechanism in accordance with this invention.

Referring now to FIG. 1 of the drawings, reference numeral 10 generally identifies a rocking, gliding chair having a stationary base 12, a body-supporting chair frame 14, and a mechanism 20 (shown in isolation in FIG. 2) for mounting the chair frame 14 on the base 12 for rocking and gliding movement relative to the base 12. Base 12 is illustrated as a circular platform, but other types of base structures can be used, such as multiple spider legs radiating outwardly from a central axis. Frame 14 includes a seat 16, a backrest 18, and a pair of armrests 22 which, in FIG. 1, are united together as one unitary structure of conventional construction, including upholstered wooden frame parts. The chair has a relatively low seat, which means that the seat 16 is positioned above the floor within a certain minimum range. Seat 16 may include a T-cushion, wherein the front ends of the cushion are, as illustrated, positioned beyond the armrests 22.

Figure 2:
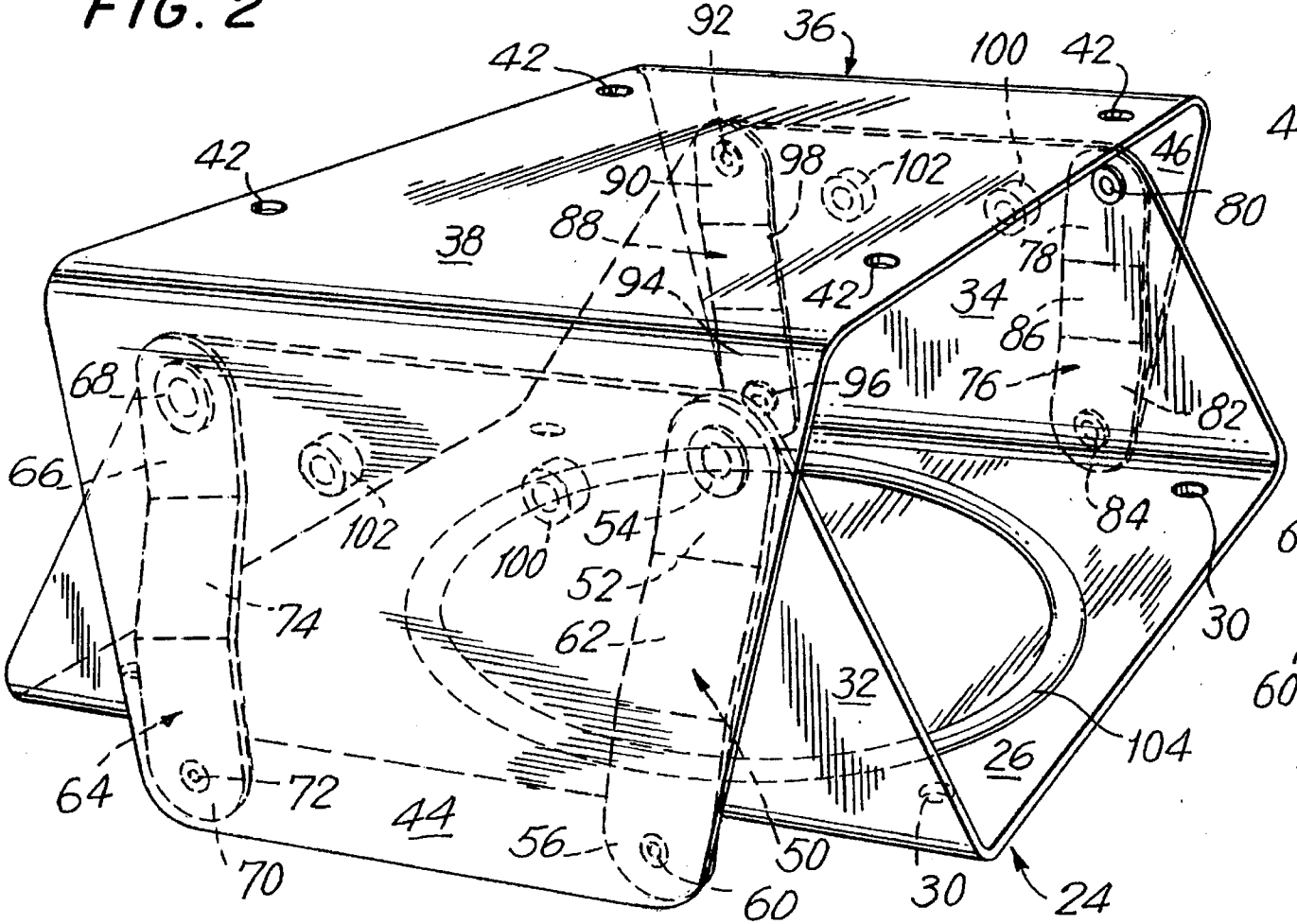
FIG. 2 is an enlarged perspective view of the mechanism used in the chair of FIG. 1.

Referring now to FIG. 2, the mechanism 20 includes a channel-shaped base mounting member 24 having a generally planar base plate 26 mounted on the base 12. Non-illustrated threaded fasteners passing through mounting holes 30 could be used for a fixed mounting or, as described below, a swivel mounting could be used. Base plate 26 has a rectangular shape, and a mounting hole 30 is located at each corner. A pair of generally planar base side walls 32, 34 extend upwardly in mutually parallelism from the base plate 26. Each base side wall has a generally trapezoidal shape. Member 24 is made of a rigid metal.

Figure 5:
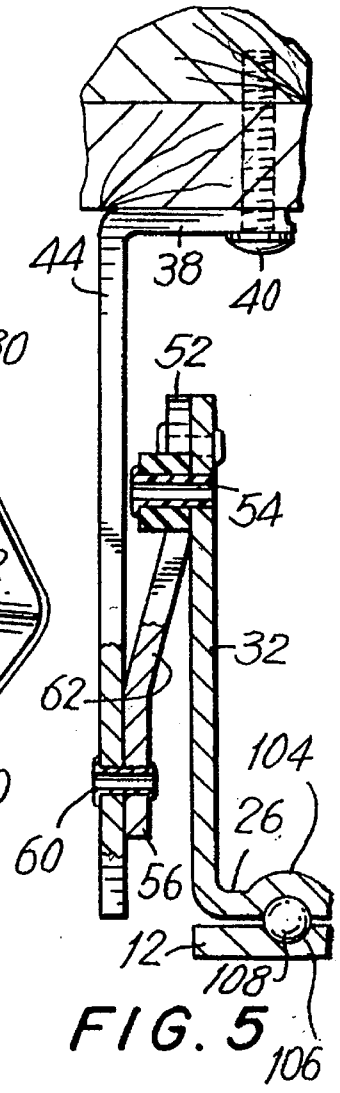
FIG. 5 is a broken-away sectional view taken along the line 5—5 of FIG. 3.

Mechanism 20 further includes a channel-shaped frame mounting member 36 inverted in a mirror-symmetrical relationship with the base mounting member 24. Frame mounting member 36 has a generally planar top plate 38 mounted to the frame 14 with the aid of threaded fasteners 40 (see FIG. 5) passing through mounting holes 42. Top plate 38 has a generally rectangular shape, and a mounting hole 42 is located at each corner. A pair of generally planar frame side walls 44, 46 extend downwardly in mutually parallelism from the top plate, and exteriorly overlap the base side walls 32, 34, respectively. Each frame side wall 44, 46 has a generally trapezoidal shape. Member 46 is also made of a rigid metal.

A front swing arm 50 has an upper end region 52 pivotably connected to a base side wall 32 at an upper front pivot 54; a lower end region 56 pivotably connected to frame side wall 44 at a lower front pivot 60; and an offset portion 62 spanning the distance between the overlapping base and frame side walls 32, 44.

A rear swing arm 64 has an upper end region 66 pivotably connected to base side wall 32 at an upper rear pivot 68; a lower end region 70 pivotably connected to frame side wall 44 at a lower rear pivot 72; and an offset portion 74 spanning the distance between the overlapping base and frame side walls 32, 44.

Another front swing arm 76 has an upper end region 78 pivotably connected to base side wall 34 at an upper front pivot 80; a lower end region 82 pivotably connected to frame side wall 46 at a lower front pivot 84; and an offset portion 86 spanning the distance between the overlapping base and frame side walls 34, 46.

Another rear swing link 88 has an upper end region 90 pivotably connected to base side wall 34 at an upper rear pivot 92; a lower end region 94 pivotably connected to frame side wall 46 at a lower rear pivot 96; and an offset portion 98 spanning the distance between the overlapping base and frame side walls 34, 46.

All of the arms are links stamped from rigid metal. Each arm has a length which, in the preferred embodiment, is less than 10.25 centimeters. Each end region of the arms constitutes a large bearing surface area, thereby enhancing resistance to side sway. The longitudinal distance between the front and rear upper pivots 54, 68 and 80, 92, also known as the predetermined upper spacing, is less than 18 centimeters. The longitudinal distance between the front and rear lower pivots 60, 72 and 84, 96, also known as the predetermined lower spacing, is less than 14.5 centimeters. The upper spacing is always greater than the lower spacing in order to achieve the gliding action.

Front stops 100, advantageously constituted as cushioned stop pins, are fixedly mounted on, and co-linearly extend outwardly of, base side walls 32, 34 toward, but terminating short of, the overlapping frame side walls. Rear stops 102, also constituted as cushioned stop pins, are fixedly mounted on, and co-linearly extend outwardly of, base side walls 32, 34 toward, but terminating short of, the overlapping frame side walls. The front and rear stops are mounted at the same elevation. The front stops 100 limit rearward travel of the mechanism (see FIG. 3), and the rear stops 102 limit forward travel of the mechanism (see FIG. 4).

Figure 3:
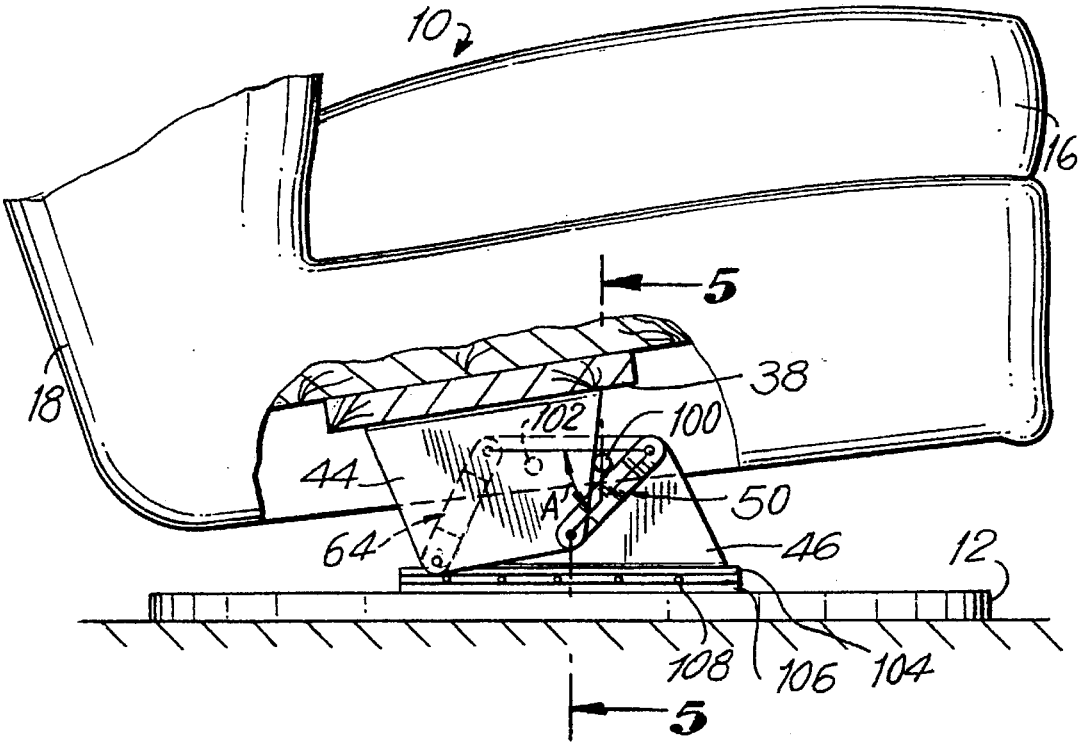
FIG. 3 is a broken-away view of the chair of FIG. 1 in a rear, end-limiting tilted position.
Figure 4:
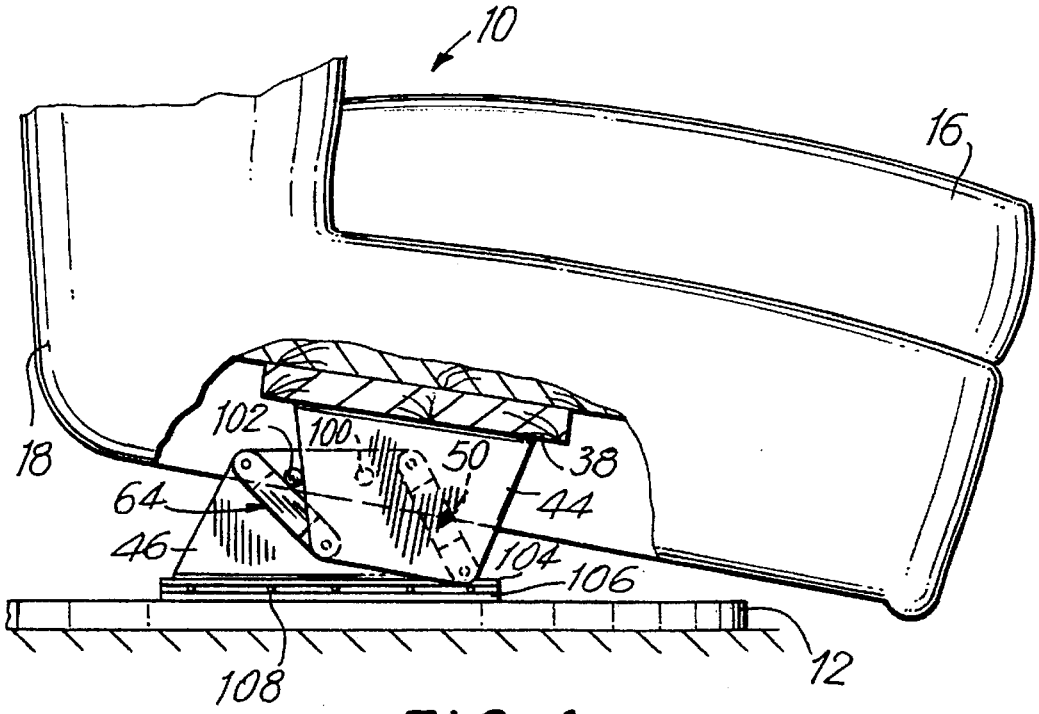
FIG. 4 is a view analogous to FIG. 3, but showing the chair in a forward, end-limiting position.

In operation, a seated occupant shifts his or her weight to move the chair between the rearward and forward tilted positions of FIGS. 3 and 4. The end-limiting positions are defined by the stop pins 100, 102. The angle "A" in FIG. 3 is defined as the angle included between each front swing arm and a line extending through the respective upper front and rear pivots of the front and rear arms. This angle "A" can be anywhere in a range of 21° through 130° and the chair will still exhibit great stability.

It will further be noted from FIGS. 3 and 4 that the swing arms are virtually always covered by the side walls of the frame and base members, thereby providing lateral protection of the swing arms. Also, there are no cross-stabilizer bars between the front swing arms, or between the rear swing arms. The channel-shaped frame and base mounting members provide for a high degree of resistance to side sway. It is also noted that the seat, more precisely the wooden frame elements of the seat, are directly mounted on top of the top plate of the frame mounting member, thereby ensuring a simple, rapid assembly, and without sacrificing chair stability.

The mechanism herein can also provide for a swivel motion about a vertical axis. For this purpose, the underside of the base plate 26 is formed with a circular race 104, and the upper side of the base is formed with a corresponding circular race 106. A plurality of ball beatings 108 is mounted in both races. Thus, for very little additional expense, a rocking, gliding chair can also be equipped with a swivel motion.

Figure 6:
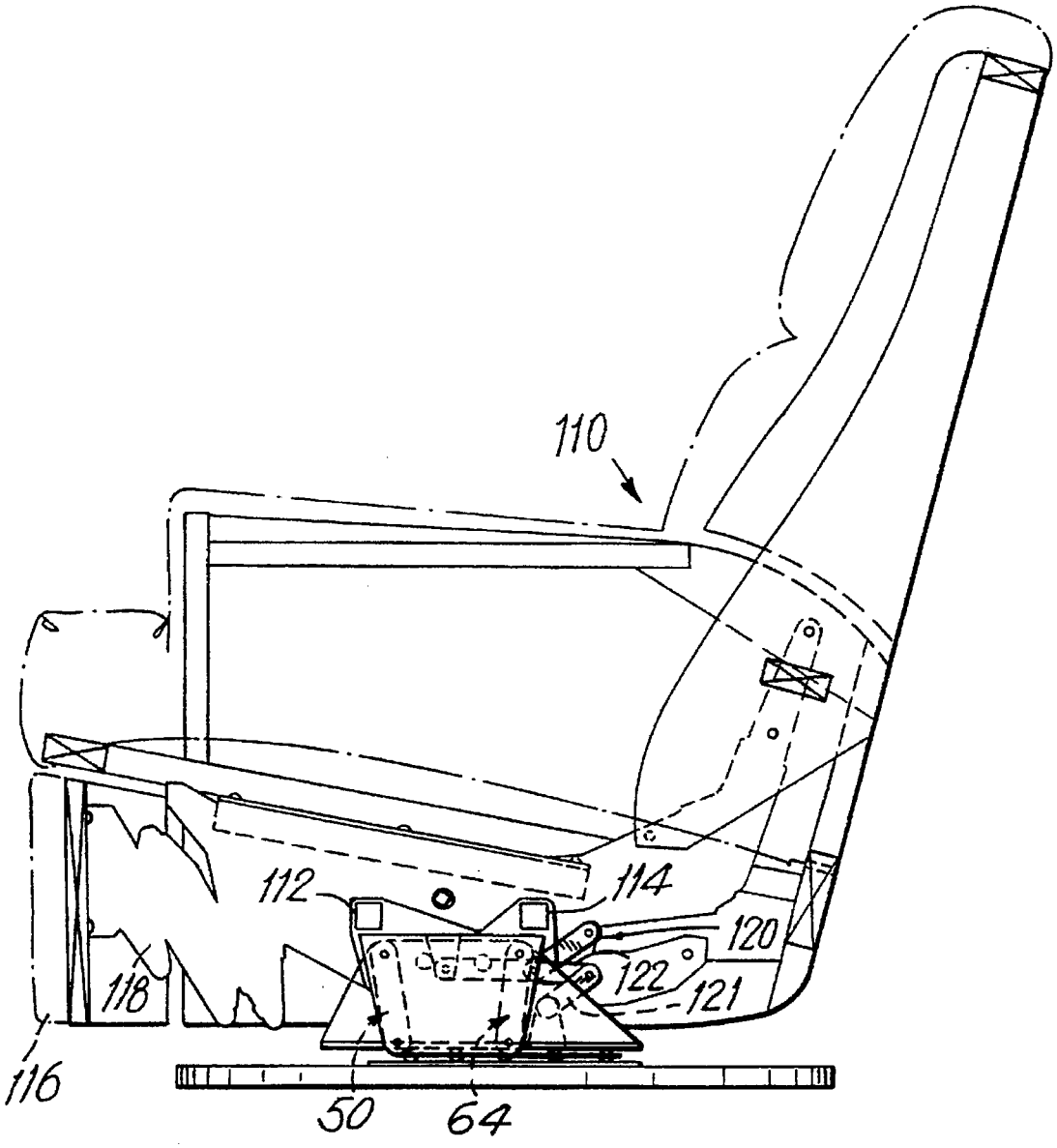
FIG. 6 is a sectional view of a reclining chair equipped with a modified mechanism in accordance with this invention.

As shown in FIG. 6, the invention may be incorporated in chairs where the backrest is movable relative to the seat, or in other action chairs, such as reclining chairs. Thus, as shown in FIG. 6, a reclining chair 110 of conventional construction may be equipped with the mechanism 20 of this invention. The mechanism 20 is in this case, conveniently mounted to a pair of fore and aft, metal tubes 112, 114 of rectangular cross-section. The tubes extend transversely underneath the seat between the armrests. In order to prevent mechanical interference with the various links of the recliner, the shapes of the side walls of the base and frame mounting members may be modified, as shown. However, the basic structure of the mechanism remains the same. The ratio of the lengths of the swing arms relative to the upper spacing and lower spacing lengths remains the same.

Recliner 110 includes a footrest 116 and a footrest linkage 118. As best shown in FIGS. 7A–7D, a blocking linkage is installed to prevent the rocking and gliding movement of the chair recliner in one of its reclined positions.

Thus, the blocking linkage includes an angled blocking link 120 having an end region 126 pivotably connected to a bracket 123 fixed to, and extending downwardly from, the top plate 38 centrally of the mechanism 20. An opposite end region 128 of the blocking link 120 is pivotably connected to the recliner linkage of the chair. A central region of the blocking link 120 is pivotably connected at pivot 130 to one end of a first, linear link 122 whose opposite end is pivotably connected at pivot 132 to one end of a second, linear link 121 whose opposite end is pivotably connected at pivot 134 to a bracket 124 fixed to, and extending upwardly from, the base plate 26 rearwardly within the mechanism and in vertical alignment with the bracket 123. A blocking pin 125 is fixed to the blocking link 120 between its end region 128 and its central region, and in vertically overlying relationship with the first link 122.

Figure 7A:
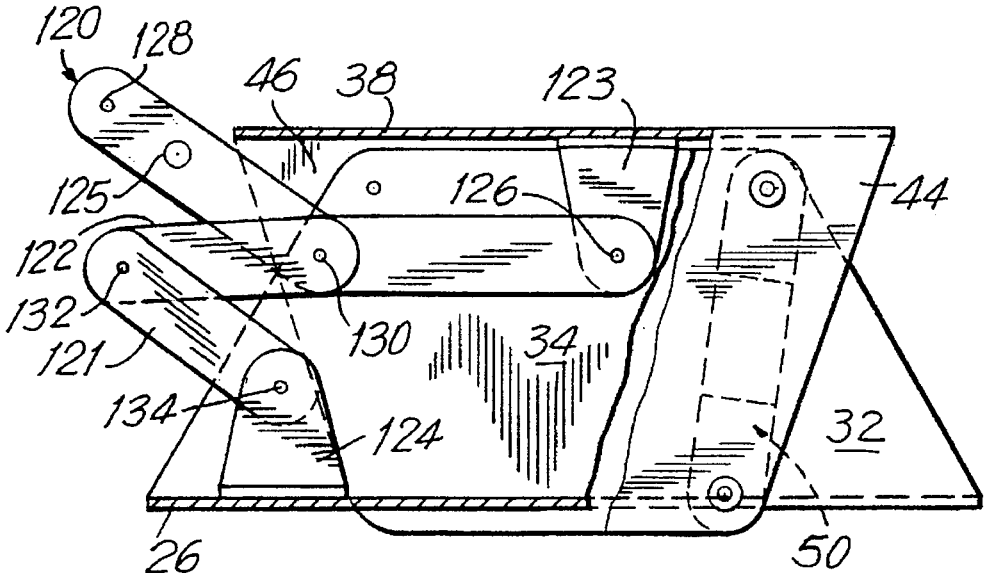
FIG. 7A is an enlarged sectional view of a modified mechanism for use in the chair of FIG. 6 in a neutral position.
Figure 7B:
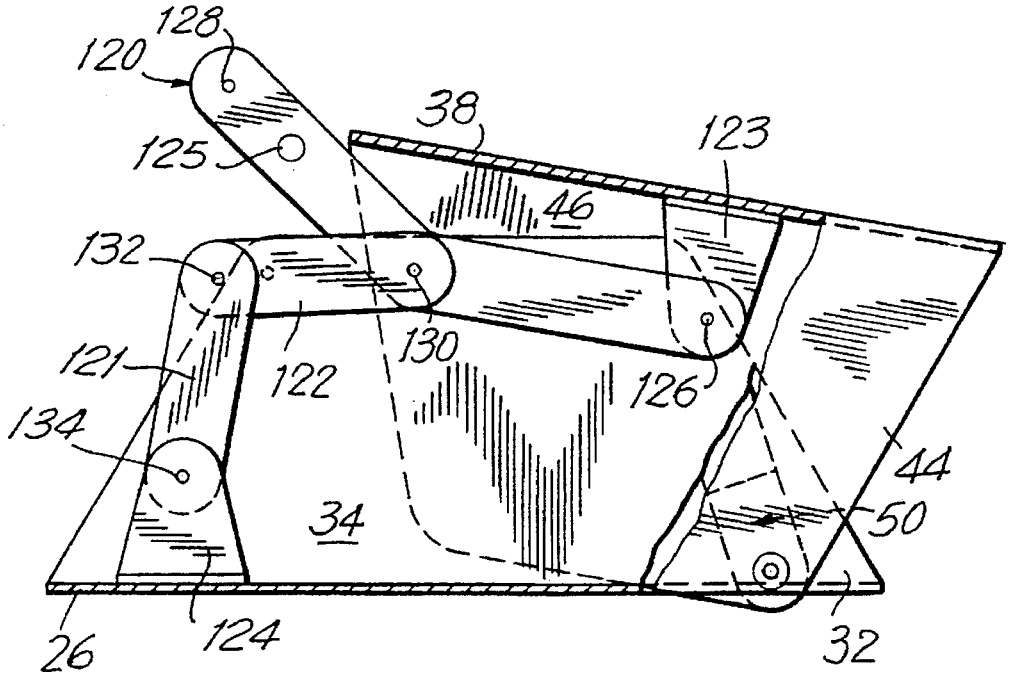
FIG. 7B is a view analogous to FIG. 7A, but in a "rocked forward" position.
Figure 7C:
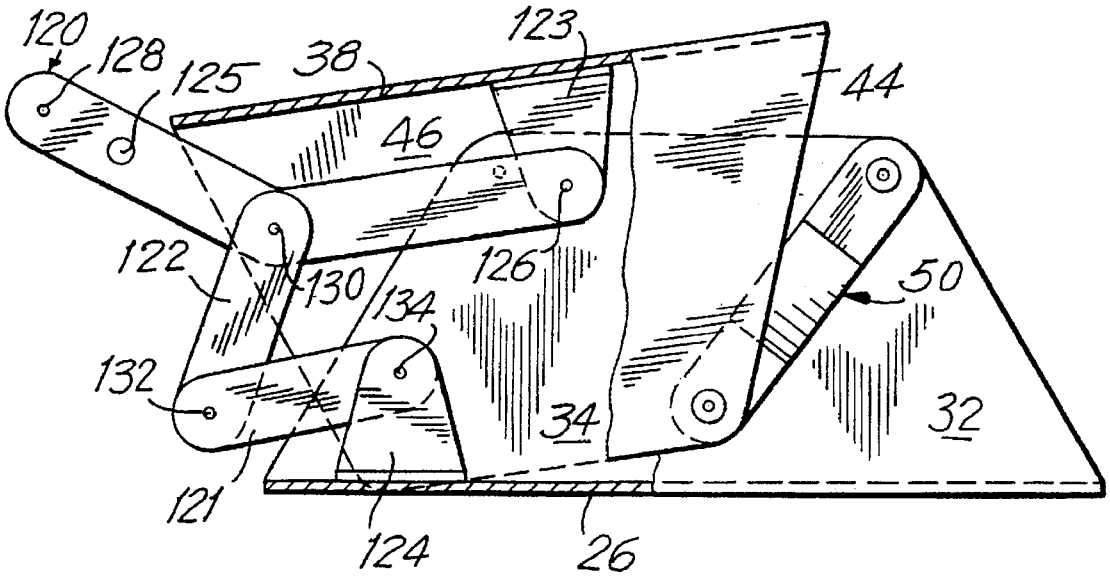
FIG. 7C is a view analogous to FIG. 7A, but in a "rocked rearward" position.
Figure 7D:
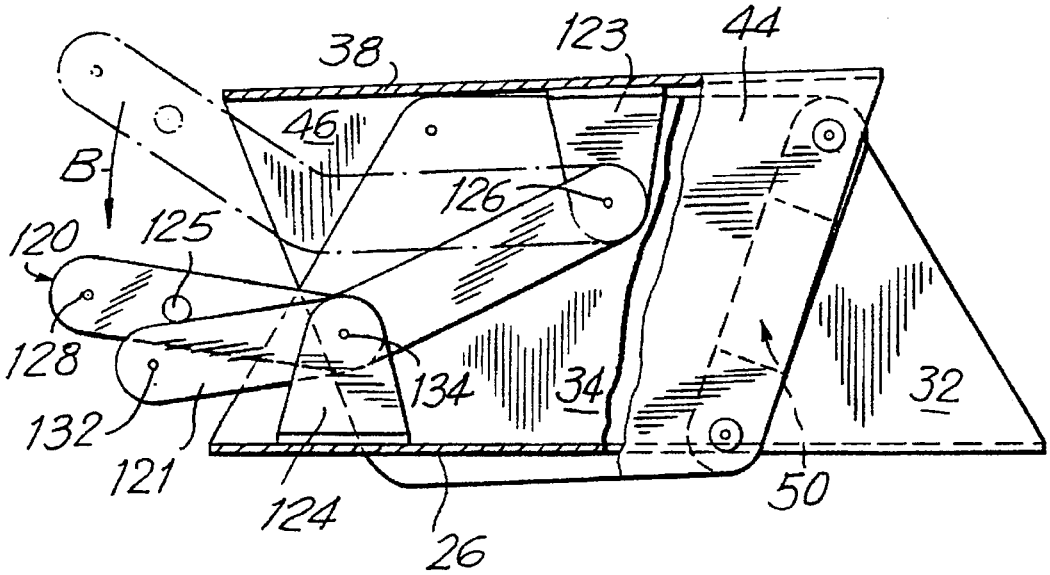
FIG. 7D is a view analogous to FIG. 7A, but in "blocked" position.

The blocking link 120 is normally constrained by the recliner linkage connected at end region 128, and links 121 and 122 are free to move between the "rocked forward" position of FIG. 7B and the "rocked rearward" position of FIG. 7C. In other words, the recliner, when it has not been moved to any reclining position, is free to perform rocking, gliding movement. However, once the recliner is moved to a reclined position, its recliner linkage forces the blocking link 120 from its neutral position, (shown by phantom lines in FIG. 7D) downwardly in the direction of the arrow B. During this downward movement, blocking pin 125 engages link 122 and pushes link 122 into alignment with link 121. The "on center" alignment between links 121, 122 prevents to-and-fro motion, thereby blocking any rocking, gliding motion in the selected reclined position. Once the recliner is moved back to its neutral position, the blocking link 120 is lifted back to its position in FIG. 7A and, as before, the chair is free to move to-and-fro between the positions of FIGS. 7B and 7C.

Figure 9:
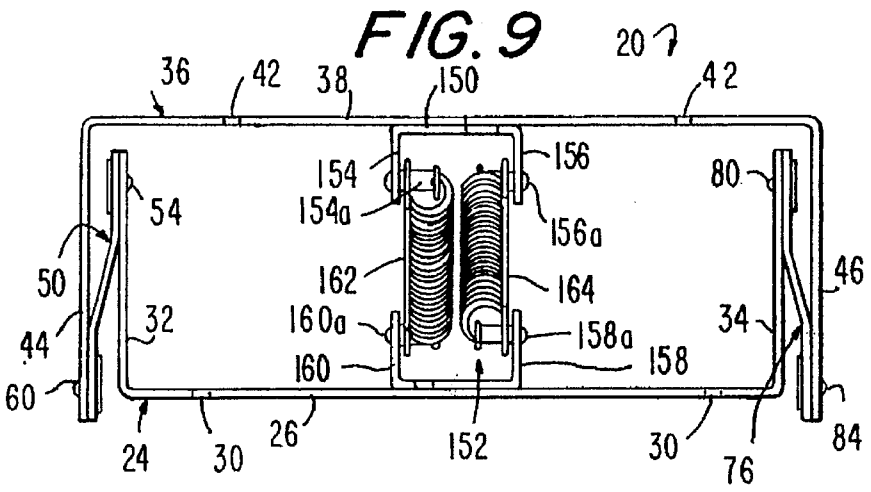
FIG. 9 is a front elevational view of the mechanism of FIG. 8.
Figure 8:
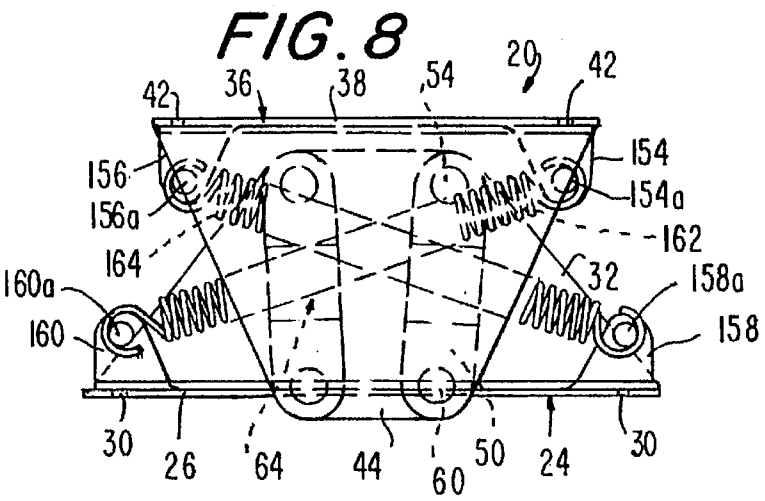
FIG. 8 is a side elevational view of the mechanism of FIG. 2, as modified with tensioned springs, for us in the chair of FIG. 1.

Turning now to FIGS. 8 and 9, the mechanism 20 is shown in side elevational view and front elevational view, respectively, and has been modified from the construction shown in FIG. 2, as follows. An upper U-shaped bracket 150 is centrally mounted within and along the frame mounting member 36. A lower U-shaped bracket 152 is centrally mounted within and along the base mounting member 24. Upper bracket 150 has front and rear lugs 154, 156 with respective posts 154*a*, 156*a*. Lower bracket 152 has front and rear lugs 158, 160 with respective posts 158*a*, 160*a*. A first coil spring 162 has opposite ends hooked onto posts 154*a*, 160*a*. A second coil spring 164 has opposite ends hooked onto posts 156*a*, 158*a*. The springs, when so mounted, are stretched and under tension and criss-cross each other in the space between the mounting members 24, 36.

As illustrated in FIGS. 8 and 9, the tension forces exerted by the springs 160, 162 are oppositely directed and tend to generally cancel themselves in the illustrated neutral or "balanced" condition. Although a balanced condition is preferred in some chair constructions, an unbalanced neutral condition may be preferred.

As an occupant shifts his or her weight between the rearward and forward tilted positions of FIGS. 3 and 4, one of the springs is stretched to a greater degree, while the other of the springs is relaxed to a greater degree, and vice versa. A resistance is introduced during both forward and rearward rocking and gliding movements. This resistance tends to restrain and control the rocking, gliding movement and has been found to impart a level of user comfort during use.

Thus, some users, while leaning back in a chair, expect a small, but non-negligible, measure of resistance. When the chair moves back without such resistance, some users mistakenly feel as if they will fall backwards. Such "free fall" is controlled by deliberately adding the aforementioned resistance not only during forward, but also during rearward, rocking and gliding movements. The speed and acceleration of such movements are reduced.

In the preferred embodiment, each spring is constructed of 41 turns of 13 gauge, hard drawn MB wire. The spring index is 7.196 which yields a relatively low stress correction factor of K=1.2. The higher the spring index, the lower the stress correction factor, thereby insuring a longer spring life. Each spring is designed so that, when mounted, it neither collapses or relaxes completely (which might cause possible spring disengagement), nor overextends or overstretches (which might cause material fatigue and spring failure).

It will be understood that each of the elements described above, or two or more together, also may find a useful application in other types of constructions differing from the types described above.

While the invention has been illustrated and described as embodied in a chair and mechanism with a restrained free rocking and gliding movement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A rocking, gliding chair, comprising:

a) a base;

b) a body-supporting chair frame, including a seat, a backrest and armrests positioned at opposite sides of the seat; and c) means for mounting the seat of the chair frame on the base for rocking and gliding movement relative to the base, including i) a one-piece, rigid, channel-shaped base mounting member having a generally planar base plate mounted on the base, and a pair of generally planar base side walls integral with the base plate and extending in mutual parallelism upwardly from the base plate, ii) a one-piece, rigid, channel-shaped frame mounting member inverted relative to the base mounting member and having a generally planar top plate overlying the base plate and mounted centrally underneath and fixed to the seat forwardly of the backrest and interiorly of the armrests, and a pair of generally planar frame side walls integral with the top plate and extending in mutual parallelism downwardly from the top plate and overlapping the base side walls interiorly of the armrests, and iii) one pair of front and one pair of rear swing arms, each pair being located between a respective base side wall and a respective overlapping frame side wall, each arm having opposite ends respectively pivotably connected to a respective base side wall and a respective overlapping frame side wall; and iv) means connected between the base mounting member and the frame mounting member, for restraining said rocking and gliding movement of the chair frame relative to the base.

2. The chair according to claim 1, wherein the restraining means includes a pair of springs each having opposite ends respectively connected to the base mounting member and the frame mounting member.

3. The chair according to claim 2, wherein the springs criss-cross each other in a central space between the mounting members.

4. The chair according to claim 3, and further comprising a pair of brackets respectively mounted on the mounting members, each bracket having a front lug and a rear lug; and wherein the opposite ends of one of the springs is connected to a front lug of one bracket and a rear lug of another bracket; and wherein the opposite ends of the other of the springs is connected to a rear lug of said one bracket and a front lug of said another bracket.

5. The chair according to claim 4, wherein each spring is mounted under tension on the brackets.

6. A mechanism for mounting a seat of a body-supporting chair frame having a backrest and armrests positioned at opposite sides of the seat on a base for rocking and gliding movement relative to the base, said mechanism including:

a) a one-piece, rigid, channel-shaped base mounting member having a generally planar base plate mounted on the base, and a pair of generally planar base side walls integral with the base plate and extending in mutual parallelism upwardly from the base plate;

b) a one-piece, rigid, channel-shaped frame mounting member inverted relative to the base mounting member and having a generally planar top plate overlying the base plate and mounted centrally underneath and fixed to the seat forwardly of the backrest and interiorly of the armrests, and a pair of generally planar frame side walls integral with the top plate and extending in mutual parallelism downwardly from the top plate and overlapping the base side walls interiorly of the armrests;

c) one pair of front and one pair of rear swing arms, each pair being located between a respective base side wall and a respective overlapping frame side wall, each arm having opposite ends respectively pivotably connected to a respective base side wall and a respective overlapping frame side wall; and d) means connected between the base mounting member and the frame mounting member, for restraining said rocking and gliding movement of the chair frame relative to the base.

7. The mechanism according to claim 6, wherein the restraining means includes a pair of springs each having opposite ends respectively connected to the base mounting member and the frame mounting member.

8. The mechanism according to claim 7, wherein the springs criss-cross each other in a central space between the mounting members.

9. The mechanism according to claim 8; and further comprising a pair of brackets respectively mounted on the mounting members, each bracket having a front lug and a rear lug; and wherein the opposite ends of one of the springs is connected to a front lug of one bracket and a rear lug of another bracket; and wherein the opposite ends of the other of the springs is connected to a rear lug of said one bracket and a front lug of said another bracket.

10. The mechanism according to claim 9, wherein each spring is mounted under tension on the brackets.

* * * * *